US007051653B2

(12) United States Patent
Ono

(10) Patent No.: US 7,051,653 B2
(45) Date of Patent: May 30, 2006

(54) IMAGE RECORDING MATERIAL SEPARATING/REMOVING DEVICE

(75) Inventor: Tsukasa Ono, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 176 days.

(21) Appl. No.: 10/373,844

(22) Filed: Feb. 27, 2003

(65) Prior Publication Data

US 2003/0170099 A1 Sep. 11, 2003

(30) Foreign Application Priority Data

Mar. 6, 2002 (JP) ..... 2002-060354

(51) Int. Cl.
*B65H 3/44* (2006.01)
*B65H 3/08* (2006.01)

(52) U.S. Cl. ..... 101/477; 101/480; 271/9.08; 271/105; 271/11; 414/416.07; 414/797

(58) Field of Classification Search ..... 101/477, 101/479, 480; 271/9.05, 9.08, 9.11, 105, 271/107, 186, 11, 104, 106, 161, 162, 164, 271/170, 9.07; 414/796.4, 797, 788, 773, 414/783, 416.03, 416.08, 416.07
See application file for complete search history.

(56) References Cited

U.S. PATENT DOCUMENTS 4,759,679 A * 7/1988 Muller ..... 414/416.01
4,878,799 A * 11/1989 Seto et al. ..... 414/331.18
5,201,506 A * 4/1993 Kushima et al. ..... 271/5
5,560,596 A * 10/1996 Okoda et al. ..... 271/106
5,992,324 A * 11/1999 Rombult et al. ..... 101/477
6,718,875 B1 * 4/2004 Ono ..... 101/477
6,739,261 B1 * 5/2004 Ono ..... 101/477
2003/0017035 A1 * 1/2003 Solomon et al. ..... 414/416.07

FOREIGN PATENT DOCUMENTS

EP 1 055 621 A2 * 11/2000
EP 1 061 019 A2 * 12/2000
JP U 57-182740 11/1982
JP 60-232338 A * 11/1985
JP 60-232339 A * 11/1985
JP A 60-236945 11/1985
JP A 11-011726 1/1999
JP A 2001-072264 3/2001

* cited by examiner

*Primary Examiner*—Leslie J. Evanisko
(74) *Attorney, Agent, or Firm*—Margaret A. Burke; Sheldon J. Moss

(57) ABSTRACT

An image recording material separating/removing device which, by using a single lift-out mechanism section, can lift image recording materials out from plural cassettes along simple loci of movement, and in which a space for providing and withdrawing the cassettes is kept as small as possible. In a cassette housing section, a plurality of cassettes are disposed one above another. Each cassette is offset in a horizontal direction. An amount of offset is set on the basis of a locus of movement of a printing plate at a time when the printing plate is sucked and held by suction cups and lifted up in a vertical direction. At least while the suction cups are moving in the vertical direction, the printing plate is not interfered with by cassettes thereabove, and an emulsion surface of the printing plate is not scratched. Space required for placement of the cassette housing section can be reduced. Moreover, because movement of the suction cups can be simplified, a control system can be simplified.

17 Claims, 4 Drawing Sheets

IMAGE RECORDING MATERIAL SEPARATING/REMOVING DEVICE

BACKGROUND OF THE INVENTION

1. Field of the Invention

The present invention relates to an image recording material separating/removing device equipped with a cassette in which image recording materials, in which an image recording surface is provided on a support, and interleaf sheets, which are thin-film-like and protect the image recording surfaces of the image recording materials, are accommodated in an alternately stacked manner. The image recording material separating/removing device discards the interleaf sheets accommodated in the cassette, and feeds the image recording materials to a subsequent process.

2. Description of the Related Art

A technique (printing plate exposure device) has come to be developed which, by using an image recording material (printing plate) in which an image recording surface (photosensitive layer) is provided on a support, records an image directly by a laser beam or the like onto an emulsion surface which serves as the photosensitive layer of the printing plate. With such a technique, it is possible to quickly record an image onto a printing plate.

In an automatic printing plate exposure device using a technique of recording an image onto a printing plate, the printing plates are removed one-by-one (separated/removed) from a cassette in which a plurality of the printing plates are stacked, and are fed to an exposure section.

The printing plates are classified into plural types in accordance with their sizes, photosensitizing methods, materials, and the like. Generally, printing plates of the same classified type are accommodated into a cassette. A plurality of cassettes containing the plural types of printing plates are stacked one above the other, i.e., in plural levels.

Conventionally, a single mechanism (a lift-out mechanism section) for removing the printing plates from the cassettes is provided. Thus, the cassettes are moved vertically or horizontally with respect to the surface on which the automatic printing plate exposure device is set, such that a space is provided at substantially the entire region above the cassette which accommodates the printing plate which is to be removed.

In this way, a printing plate can be removed from a target cassette without being interfered with by the other cassettes.

However, in order to withdraw the cassettes, a space for withdrawing the cassettes must be provided in advance, and size of the entire device increases.

In order to overcome this drawback, spaces, into which the lift-out mechanism section can enter, are provided in advance between the plural stacked cassettes. In this way, the space in the horizontal direction can be made smaller. However, the locus of movement of the pick-up mechanism becomes complex. Further, it has been thought to provide plural lift-out mechanism sections, but in this case, the structure of the device becomes complex, which is not preferable.

SUMMARY OF THE INVENTION

In view of the aforementioned, an object of the present invention is to provide an image recording material separating/removing device which can lift image recording materials up out of plural cassettes by using a single lift-out mechanism section and along simple loci of movement, and in which the space required for placement and withdrawing of cassettes can be kept as small as possible.

In order to achieve the above-described object, in accordance with an aspect of the present invention, there is provided an image recording material separating/removing device comprising: a plurality of cassettes, each cassette able to accommodate a plurality of image recording materials substantially horizontally in a stacked manner; and a conveying unit which can access each of the plurality of cassettes in order to remove the image recording materials from each of the plurality of cassettes, wherein one cassette is positioned at an offset position which is offset in a horizontal direction from a horizontal direction position of a cassette directly beneath the one cassette, at least when the conveying unit accesses the cassette directly beneath the one cassette.

DETAILED DESCRIPTION OF THE PREFERRED EMBODIMENTS

Figure 1:
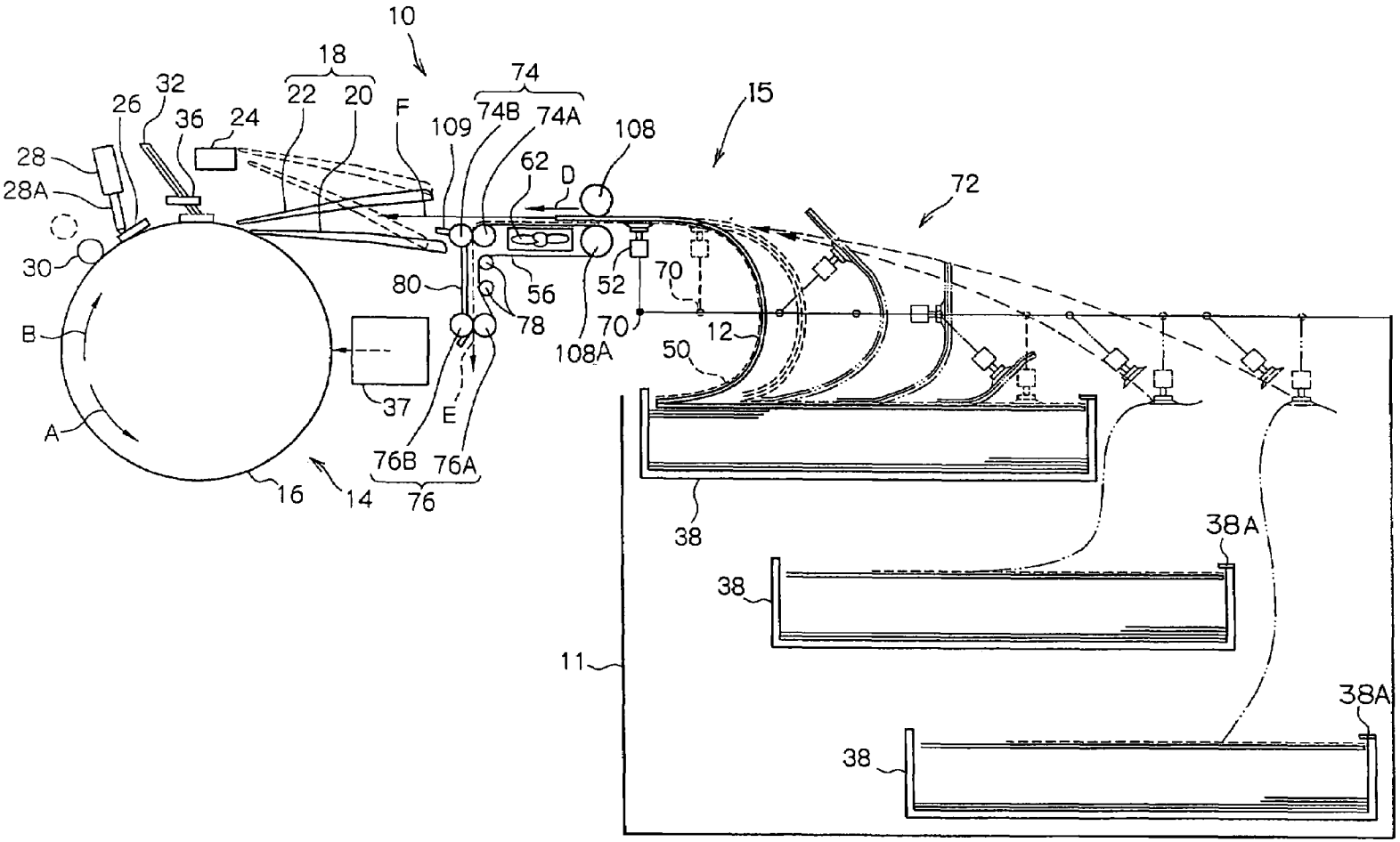
FIG. 1 is a schematic diagram of an automatic printing plate exposure device relating to an embodiment.

An automatic printing plate exposure device 10 relating to a first embodiment is shown in FIG. 1.

The automatic printing plate exposure device 10 is divided into two main sections which are an exposure section 14, which irradiates a light beam onto an image forming layer of a printing plate 12 so as to expose an image thereon, and a separating/removing/conveying section 15 which separates/removes the printing plate 12 and conveys the printing plate 12 to the exposure section 14. The printing plate 12, which has been subjected to exposure processing by the automatic printing plate exposure device 10, is fed out to a developing device (not illustrated) which is disposed adjacent to the automatic printing plate exposure device 10.

(Structure of Exposure Section)

The exposure section 14 is structured such that a rotating drum 16, around whose peripheral surface the printing plate 12 is trained and held, is the main portion of the exposure section 14. The printing plate 12 is guided by a conveying guide unit 18, and is fed into the exposure section 14 from a direction tangential to the rotating drum 16. The conveying guide unit 18 is structured by a plate supplying guide 20 and a plate discharging guide 22. Conveying rollers 108 and a guide plate 109 are disposed at the side of the conveying guide unit 18 which side borders on the separating/removing/conveying section 15.

The relative positional relationship of the plate supplying guide 20 and the plate discharging guide 22 of the conveying guide unit 18 is such that the plate supplying guide 20 and the plate discharging guide 22 form a sideways V shape. The plate supplying guide 20 and the plate discharging guide 22 rotate by predetermined angles around the right end portion sides thereof in FIG. 1. Due to this rotation, the plate supplying guide 20 can selectively be positioned at a position corresponding to the rotating drum 16 (i.e., a position of being disposed in a direction tangential to the rotating drum 16), and a position in a direction of inserting the printing plate 12 into a puncher 24 which is provided above the rotating drum 16.

The printing plate 12 which has been fed out from the separating/removing/conveying section 15 is first guided by the plate supplying guide 20 and fed into the puncher 24 where notches for positioning are formed in the leading end of the printing plate 12.

After the printing plate 12 undergoes processing at the puncher 24 as needed, the printing plate 12 is returned to the plate supplying guide 20 and then moved to a position corresponding to the rotating drum 16.

The rotating drum 16 is rotated by an unillustrated driving means in a direction in which the printing plate 12 is attached and exposed (the direction of arrow A in FIG. 1), and in a direction in which the printing plate 12 is removed (the direction of arrow B in FIG. 1) which is opposite to the attaching/exposing direction.

As shown in FIG. 1, leading end chucks 26 are mounted to predetermined positions of the outer peripheral surface of the rotating drum 16 provided in the exposure section 14. At the exposure section 14, when the printing plate 12 is to be attached to the rotating drum 16, first, the rotating drum 16 is stopped at a position (printing plate attaching position) at which the leading end chucks 26 oppose the leading end of the printing plate 12 which has been fed in by the plate supplying guide 20 of the conveying guide unit 18.

An attaching unit 28 is provided in the exposure section 14 so as to oppose the leading end chucks 26 at the printing plate attaching position. Due to extending/retracting rods 28A of the attaching unit 28 extending such that one end sides of the leading end chucks 26 are pushed, the printing plate 12 can be inserted between the other end sides of the leading end chucks 26 and the peripheral surface of the rotating drum 16.

In the exposure section 14, in the state in which the leading end of the printing plate 12 is inserted between the leading end chucks 26 and the rotating drum 16, the extending/retracting rods 28A of the attaching unit 28 are pulled back such that their pressing of the leading end chucks 26 is released. In this way, the leading end of the printing plate 12 is nipped and held between the leading end chucks 26 and the peripheral surface of the rotating drum 16.

At this time, the printing plate 12 is positioned due to the leading end thereof abutting positioning pins (not shown) provided on the rotating drum 16.

At the exposure section 14, when the leading end of the printing plate 12 is fixed to the rotating drum 16, the rotating drum 16 is rotated in the attaching/exposing direction (the direction of arrow A). In this way, the printing plate 12, which has been fed in from the plate supplying guide 20 of the conveying guide unit 18, is trained about the peripheral surface of the rotating drum 16.

A squeeze roller 30 is provided at the downstream side, in the attaching/exposing direction (the direction of arrow A in FIG. 1), of the printing plate attaching position, in a vicinity of the peripheral surface of the rotating drum 16. Due to the squeeze roller 30 moving toward the rotating drum 16, the printing plate 12 which is trained on the rotating drum 16 is pushed toward the rotating drum 16 and is made to fit tightly to the peripheral surface of the rotating drum 16.

Further, a trailing end chuck attaching/removing unit 32 is disposed in the exposure section 14 in a vicinity of the upstream side of leading end chucks 26 in the attaching/exposing direction of the rotating drum 16. At the trailing end chuck attaching/removing unit 32, trailing end chucks 36 move along guides which project toward the rotating drum 16.

In the exposure section 14, when the trailing end of the printing plate 12 which is trained on the rotating drum 16 opposes the trailing end chuck attaching/removing unit 32, the trailing end chucks 36 are moved toward the rotating drum 16 and are attached to predetermined positions on the rotating drum 16. In this way, the trailing end of the printing plate 12 is nipped and held between the trailing end chucks 36 and the rotating drum 16.

In the exposure section 14, when the leading end and the trailing end of the printing plate 12 are held at the rotating drum 16, the squeeze roller 30 is moved away (refer to the chain line in FIG. 1). Thereafter, in the exposure section 14, while the rotating drum 16 is rotated at high speed at a predetermined rotational speed, a light beam, which is modulated on the basis of image data, is irradiated from a recording head portion 37 synchronously with the rotation of the rotating drum 16. In this way, the printing plate 12 is scan-exposed on the basis of the image data.

In the exposure section 14, when the scan-exposure of the printing plate 12 has been completed, the rotating drum 16 is temporarily stopped so as to be positioned at a position at which the trailing end chucks 36, which are holding the trailing end of the printing plate 12, oppose the trailing end chuck attaching/removing unit 32, and the trailing end chucks 36 are removed from the rotating drum 16. In this way, the trailing end of the printing plate 12 is freed.

Thereafter, by rotating the rotating drum 16 in the direction of removing the printing plate 12 (the direction of arrow B), the printing plate 12 is discharged, from the trailing end side thereof, to the plate discharging guide 22 of the conveying guide unit 18 along a direction tangential to the rotating drum 16. Thereafter, the printing plate 12 is conveyed to the developing device which is the subsequent process.

(Structure of Separating/Removing/Conveying Section)

As shown in FIG. 1, a cassette housing section 11 of a predetermined space is provided at the separating/removing/conveying section 15. Cassettes 38, which are parallel to the surface on which the automatic printing plate exposure device 10 is placed, are provided in the cassette housing section 11. A plurality of the cassettes 38 are provided so as to be stacked one above the other.

Here, the cassettes 38 of the present embodiment are provided one above the other in a manner in which they are offset from one another in the horizontal direction. The amounts of offset are set on the basis of the loci of movement at the time when the printing plates 12 (and the interleaf sheets 50) are lifted-up out from the cassettes 38 by suction cups 52 which will be described later.

In the separating/removing/conveying section 15, a plurality of the suction cups 52 are disposed at predetermined pitch intervals at a base plate (not shown) which is provided along the transverse direction of the printing plate 12. The suction cups 52 are classified into a plurality of systems. In this way, on the basis of the size of the printing plate 12, a system is selected and a sucking function is imparted to the selected system such that the printing plate 12 can thereby be sucked in a well-balanced manner.

A moving mechanism 72 is provided above the cassettes 38. In the moving mechanism 72, the suction cups 52 are supported at base points 70 in a state in which the suction cups 52 hang downward. The moving mechanism 72 moves the base points 70 substantially horizontally in the left-right direction of the cassettes 38 in FIG. 1.

The moving mechanism 72 is structured by a plate which supports the plurality of suction cups 52 along the transverse direction of the cassettes 38, and a pair of rails across which the plate spans. (The plate and the rails are not illustrated.)

The base points 70 which support the suction cups 52 are rotatable. Here, when the printing plate 12 is to be lifted out from the cassette 38, the plate to which the suction cups 52 are mounted is positioned on the rails at the right end portion, in FIG. 1, of the cassette 38 from which the printing plate 12 is to be removed.

Figure 2:
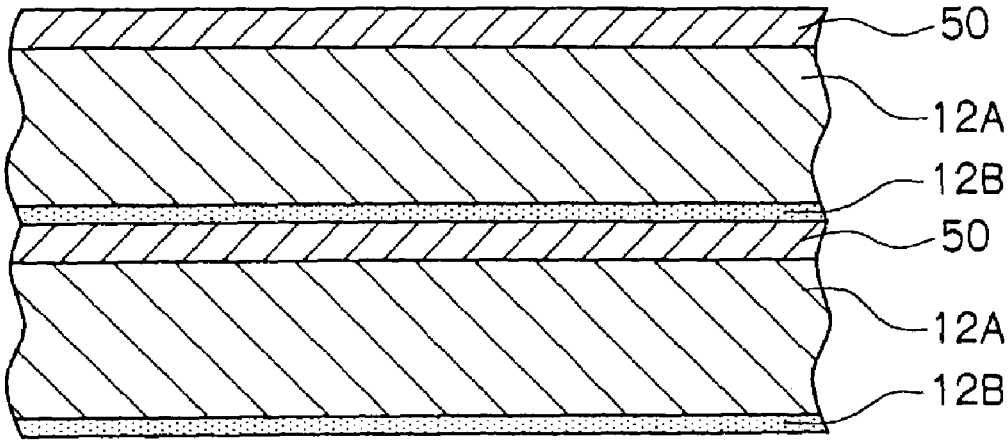
FIG. 2 is a side view showing a state in which interleaf sheets and printing plates are stacked in a cassette which is applied to the automatic printing plate exposure device relating to the embodiment.

As shown in FIG. 2, the interleaf sheets 50 and the printing plates 12, whose emulsion surfaces (image recording surfaces) 12B are facing downward, are stacked alternately in the cassette 38. Thus, the suction cups 52 contact the interleaf sheet 50 which is the topmost layer within the cassette 38. Reference numeral 12A is a support (see FIG. 2).

When suction force is imparted to the suction cups 52 at the point in time when they contact the uppermost interleaf sheet 50, the suction force is applied to the uppermost interleaf sheet 50, and is transferred as well as to the printing plate 12 immediately therebeneath. The interleaf sheet 50 and the printing plate 12 are thereby sucked and lifted up as a pair. Note that, although the raising and lowering of the suction cups 52 is omitted from illustration in FIG. 1, the suction cups 52 are lowered to the heightwise position of each cassette 38, and are raised to their topmost positions in a state in which the interleaf sheets 50 and the printing plates 12, which are other than and which are beneath the interleaf sheet 50 and the printing plate 12 which are being sucked, have been separated by a separating plate 38A provided at each cassette 38.

At this time, in the vertical direction lifting up of the printing plates 12 from the cassettes 38 of the respective levels, there are different loci of movement due to the lengths (left-right direction lengths in FIG. 1) of the printing plates 12. Namely, in a case in which three levels of the cassettes 38 are provided as in the present embodiment, when the printing plate 12 is to be lifted up out from the uppermost cassette 38, only the leading end portion of the printing plate 12 is lifted up. When the printing plate 12 is to be lifted up out from the middle cassette 38, about ⅔ of the printing plate 12 is lifted up. When the printing plate 12 is to be lifted up out from the lowermost cassette 38, the entire printing plate 12 is in a state of being suspended downward.

In this state, the plate which supports the suction cups 52 begins to rotate counterclockwise in FIG. 1 around the base points 70, and begins to move toward the left, in FIG. 1, of the cassettes 38 along the rails. In this way, the suction points of the suction cups 52 move while tracing a so-called cycloid curve. As can be seen in FIG. 1, the conveying unit substantially inverts the image recording material 12 by suctioning one end of the image recording material, and raising up and conveying the one end such that the one end faces the other end of the recording material (depicted in dashed lines for the top cassette).

The amounts by which the respective cassettes 38 are offset are set on the basis of the loci of movement. As seen in FIG. 1, the amount of offset of each cassette is less than a length of one cassette. Therefore, regardless of which cassette 38 the printing plate 12 (and the interleaf sheet 50) is lifted out from, the printing plate 12 (and the interleaf sheet 50) can be lifted out substantially without being interfered with by the cassettes 38 thereabove.

Note that it is most preferable for there to be absolutely no interference between the printing plate 12 and the cassettes 38 thereabove. However, the surface abutting the cassette 38 is the reverse surface side of the printing plate 12. Therefore, assuming that the space, as seen in plan view, of the cassette housing section 11 is made to be small, the printing plate 12 may slightly contact the cassette 38 when the suction cups 52 are moving in the left-right direction (the horizontal direction), provided that contact at the time when the suction cups are being raised (being moved in the vertical direction) and are being rotated is avoided.

When the suction cups 52 have been rotated by 180°, the interleaf sheet 50 is now at the lower side and the printing plate 12 is now at the upper side in the state shown in FIG. 1, and the interleaf sheet 50 and the printing plate 12 are transferred to the conveying rollers 108.

A belt 56 is trained around a roller 108A which is the lower roller of the conveying rollers 108. The belt 56 is mesh-like, and is also trained around a roller 74A which is the right side roller of a pair of rollers 74 provided in a vicinity of the conveying guide unit 18 of the exposure section 14.

A pair of rollers 76 is provided beneath the pair of rollers 74. The belt 56 is trained around a right side roller 76A of the lower rollers 76, and along a pair of small rollers 78 so as to form a substantially L-shaped loop overall. The belt 56 is driven in the direction of arrow D in FIG. 1.

Note that a guide plate 80 is provided between a left side roller 74B of the upper pair of rollers 74 and a left side roller 76B of the lower pair of rollers 76.

A fan 62 is provided at the inner side of the belt 56 which forms a loop. Via the mesh holes of the belt 56, the fan 62 sucks the interleaf sheet 50 which has been placed on the belt 56 and which is being conveyed on the surface of the belt 56.

Due to this sucking, the sticking together of the interleaf sheet 50 and the printing plate 12 is cancelled. Only the interleaf sheet 50 is guided between the upper pair of rollers 74, is fed to the lower pair of rollers 76, and is discarded (refer to the chain-line arrow E in FIG. 1).

On the other hand, the printing plate 12 passes above the upper pair of rollers 74 and is fed to the plate supplying guide 20 (refer to the solid-line arrow F in FIG. 1).

Operation of the present embodiment will be described hereinafter.

When the printing plate 12 is to be removed from the cassette 38, one of the cassettes 38, which are placed one above the other in plural levels, is specified.

When a cassette 38 is specified, the suction cups 52 are positioned in a vicinity of the right end portion (in FIG. 1) of the specified cassette 38.

After positioning, the suction cups 52 are lowered to the heightwise position of the cassette 38. Although the heightwise positions of the cassettes 38 are respectively different, in each case, the movement of the suction cups 52 is simple, rectilinear movement.

When the suction cups 52 are lowered, they contact the interleaf sheet 50 which is the uppermost material in the specified cassette 38. In this state, sucking by the suction cups 52 is started, and raising of the suction cups 52 is started. During this raising, the suction cups 52 suck, together with the interleaf sheet 50 which is the topmost layer, the printing plate 12 which is disposed directly beneath that interleaf sheet 50.

Here, there are cases in which, when the interleaf sheet 50 and the printing plate 12 move away from the cassette 38, the interleaf sheet 50 or the printing plate 12 therebeneath stick to the sucked printing plate 12 due to static electricity. At this time, the sticking interleaf sheet 50 or printing plate 12 is separated from the sucked printing plate 12 by the separating plate 38A provided at the cassette 38. In this way, only the interleaf sheet 50 which is the uppermost layer and which is receiving the suction force, and the printing plate 12 directly therebeneath, are lifted up out of the cassette 38.

In the present embodiment, the three cassettes 38 are stacked one above the other. The loci of movement of the printing plates 12 (and the interleaf sheets 50), at the time when the printing plates 12 (and the interleaf sheets 50) are being lifted up out of the three cassettes 38 (i.e., at the time when the suction cups 52 are returning to their original topmost positions), are respectively different.

Namely, when the printing plate 12 is to be lifted out from the uppermost cassette 38, only the leading end portion of the printing plate 12 is lifted out, and the remaining portion of the printing plate 12 remains stacked within the cassette 38. When the printing plate 12 is lifted out from the uppermost cassette 38, it is not possible for the printing plate 12 to be interfered with by any other cassettes 38. Therefore, the printing plate 12 is conveyed to the exposure section 14 without interference around that printing plate 12.

When the printing plate 12 is to be lifted out from the middle cassette 38, there is the possibility that the cassette 38 thereabove (i.e., the uppermost cassette 38) will obstruct the printing plate 12. However, in the present embodiment, the middle cassette 38 is disposed so as to be offset with respect to the uppermost cassette 38. Therefore, in the same way as when the printing plate 12 is lifted up out of the uppermost cassette 38, the suction cups 52 are lowered and raised vertically, and the printing plate 12 (and the interleaf sheet 50) can thereby be lifted up out of the middle cassette 38. Here, when the suction cups 52 have returned to their original, topmost positions, approximately ⅔ of the printing plate 12 is lifted up. However, because the cassettes 38 are offset from one another, there is no interference with the cassette 38 thereabove.

Moreover, when the printing plate 12 is to be lifted out from the bottom cassette 38, there is the possibility that the cassettes 38 thereabove (the uppermost and middle cassettes 38) will obstruct the lifting up of the printing plate 12. However, in the present embodiment, the bottom cassette 38 is disposed so as to be offset with respect to the cassettes 38 thereabove. Therefore, in the same way as when the printing plate 12 is lifted up out of the uppermost cassette 38 or the middle cassette 38, the suction cups 52 are lowered and raised vertically, and the printing plate 12 (and the interleaf sheet 50) can thereby be lifted up out of the bottom cassette 38. Here, when the suction cups 52 have returned to their original, topmost positions, the entire printing plate 12 is suspended downward. However, because the cassettes 38 are offset from one another, there is no interference with the cassettes 38 thereabove.

When the suction cups 52 lift up the printing plate 12 (and the interleaf sheet 50) and reach their topmost positions, the suction cups 52 move horizontally toward the exposure section 14 while rotating 180° around the base points 70. At this time, the printing plate 12 pick-up positions (the points at which the printing plate 12 is sucked by the suction cups 52) move while tracing a so-called cycloid curve. Thus, the printing plate 12 (and the interleaf sheet 50), which have been lifted up out of one of the lower-level cassettes 38 and which intrinsically have a given amount of stiffness, are conveyed while circling around the cassettes 38 thereabove. Thus, there is hardly any contact of the printing plate 12 (and the interleaf sheet 50) with the cassettes 38 thereabove. Note that, because the portion of the printing plate 12 which may contact the cassettes 38 thereabove is the reverse surface side of the printing plate 12, some contact is permitted.

As can be seen in FIG. 1, the conveying unit substantially inverts the image recording material 12 by suctioning one end of the image recording material, and raising up and conveying the one end such that the one end faces the other end of the recording material (depicted in dashed lines for the top cassette). The printing plate 12 (and the interleaf sheet 50) which have been rotated by 180° are transferred to the conveying rollers 108.

Here, it necessary to convey only the printing plate 12 to the exposure section 14, and the interleaf sheet 50 is not needed. Thus, in the present embodiment, a belt conveyor unit 54 is provided along the guide plate 109.

The belt 56 of the belt conveyor unit 54 is mesh-like. By driving the fan 62 which is provided within the endless loop, the interleaf sheet 50 is sucked by the fan 62. Namely, the interleaf sheet 50 only sticks to the printing plate 12 due to so-called static electricity. Therefore, when the interleaf sheet 50 receives the suction force of the fan 62, the suction force prevails over the sticking force caused by the static electricity, and the interleaf sheet 50 can be peeled off from the printing plate 12.

As the belt 56 is driven, the interleaf sheet 50 which has been peeled off is conveyed, and is discarded in the unillustrated discard box.

On the other hand, the printing plate 12 continues to be conveyed substantially horizontally on the guide plate 109, and is fed to the plate supplying guide 20.

The printing plate 12 on the plate supplying guide 20 is fed to the rotating drum 16, and the leading end portion of the printing plate 12 is held by the leading end chucks 26. In this state, due to the rotating drum 16 rotating, the printing plate 12 is trained tightly onto the peripheral surface of the rotating drum 16. Thereafter, the trailing end of the printing plate 12 is held by the trailing end chucks 36. Preparations for exposure are thereby completed.

In this state, image data is read, and exposure processing by the light beam from the recording head portion 37 is started. The exposure processing is so-called scan-exposure in which the recording head portion 37 is moved in the axial direction of the rotating drum 16 while the rotating drum 16 is rotated at high speed (main scanning).

When exposure processing is completed, the conveying guide unit 18 is switched (the plate discharging guide 22 is made to correspond to the rotating drum 16). Next, the printing plate 12 which is trained on the rotating drum 16 is discharged out from a direction tangential to the rotating drum 16. At this time, the printing plate 12 is fed to the plate discharging guide 22.

When the printing plate 12 is fed to the plate discharging guide 22, the conveying guide unit 18 is switched such that the plate discharging guide 22 is made to correspond to the discharge opening, and the printing plate 12 is discharged. The developing section is provided in the discharging direction, and thus, the printing plate 12 is then subjected to developing processing.

As described above, in the present embodiment, when a plurality of cassettes are disposed one above the other within the cassette housing section 11, the respective cassettes 38 are offset from one another in the horizontal direction. The amount of offset is set on the basis of the locus of movement of the printing plate 12 (and the interleaf sheet 50) at the time when the printing plate 12 (and the interleaf sheet 50) are sucked and held by the suction cups 52 and are lifted out in the vertical direction. At least during the time when the suction cups 52 are moving vertically, the printing plate 12 (and the interleaf sheet 50) are not interfered with by the cassettes 38 thereabove, and, in particular, the emulsion surface 12B of the printing plate 12 is not scratched.

Further, because there is no need to provide a space over the entire region above the cassettes 38, the space occupied by the cassette housing section 11 as seen in plan view can be made smaller. The space for placement of the automatic printing plate exposure device 10 on the whole can be made smaller.

Moreover, there is no need to provide, for each cassette 38, the separating/removing/conveying section 15 which is formed by the suction cups 52 or the like, and the movement of the suction cups 52 can be simplified. Therefore, the control system can be simplified.

Figure 3:
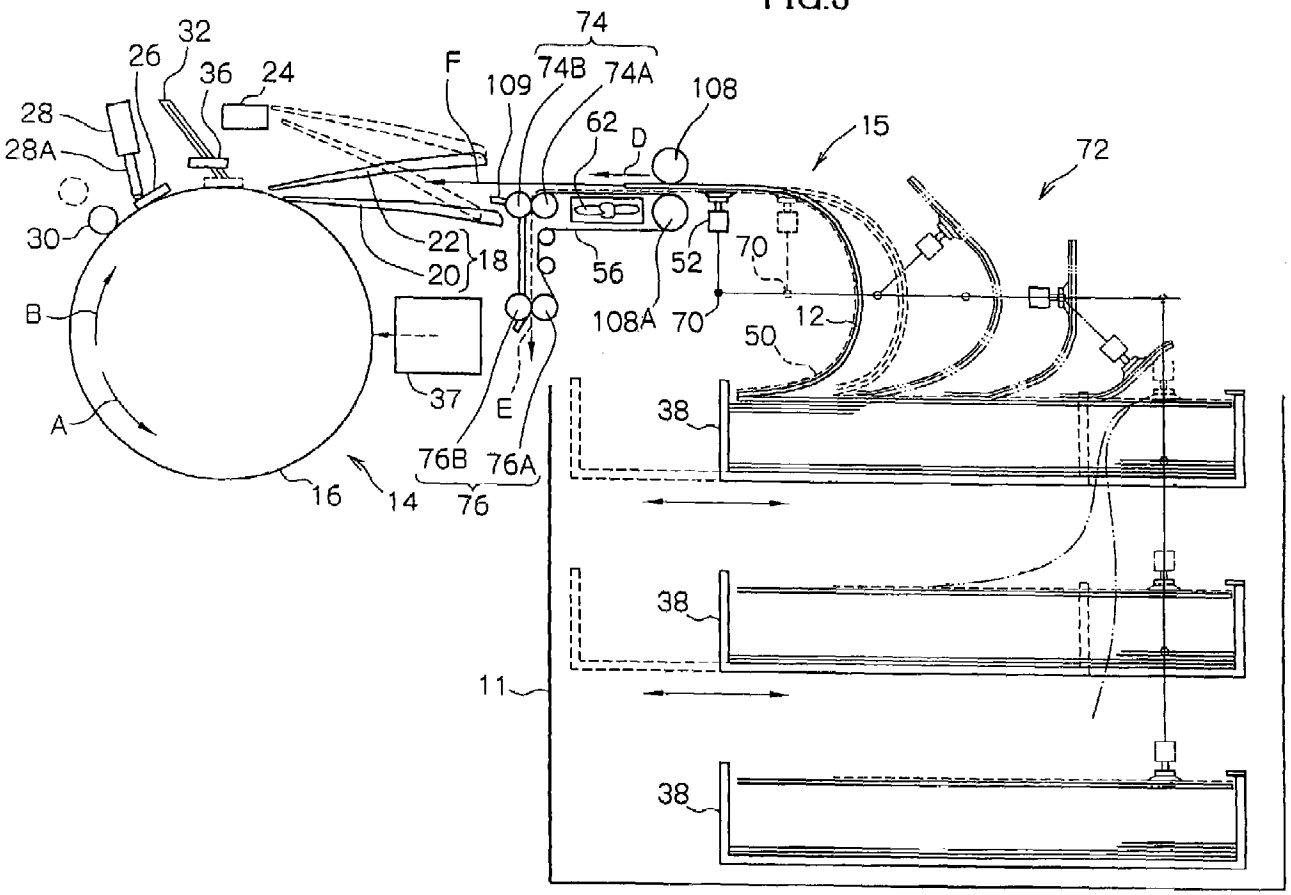
FIG. 3 is a schematic diagram showing an automatic printing plate exposure device relating to a modified example.

In the present embodiment, the three cassettes are disposed in a fixed manner and so as to be offset from one another. However, the structure shown in FIG. 3 may be used. In FIG. 3, the uppermost and middle cassettes 38 are slidable by the amounts by which they are offset in FIG. 1 the amount being less than the length of one cassette. The three cassettes 38 are usually placed one above the other within the same region. When the cassette 38 which is accommodating the printing plate 12 which is to be lifted out is specified, the cassettes 38 thereabove are moved so as to be offset. Because the cassettes 38 are structured so as to be slidable, there is no need to dispose the plural levels of cassettes 38 in a step-like arrangement. As compared with the previously-described embodiment, the space, as seen in plan view, occupied by the cassette housing portion 11 can be reduced.

Figure 4A:
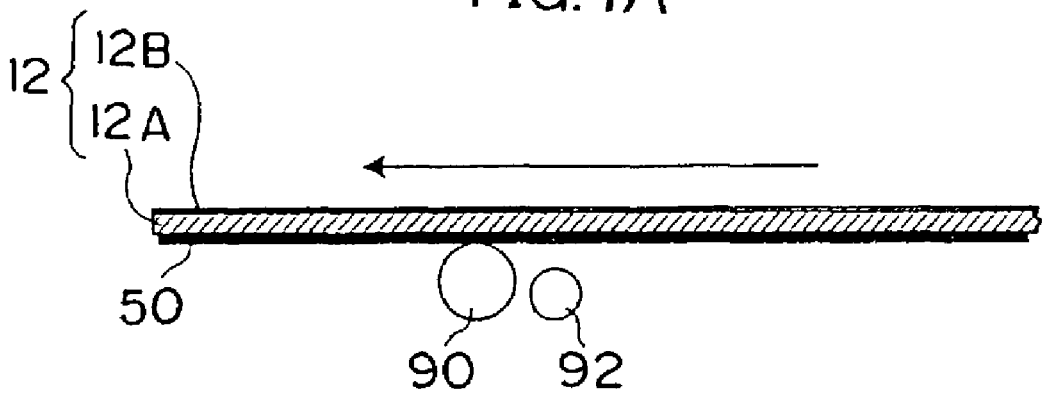
FIGS. 4A and 4B are schematic diagrams showing a modified example of interleaf sheet peeling.
Figure 4B:
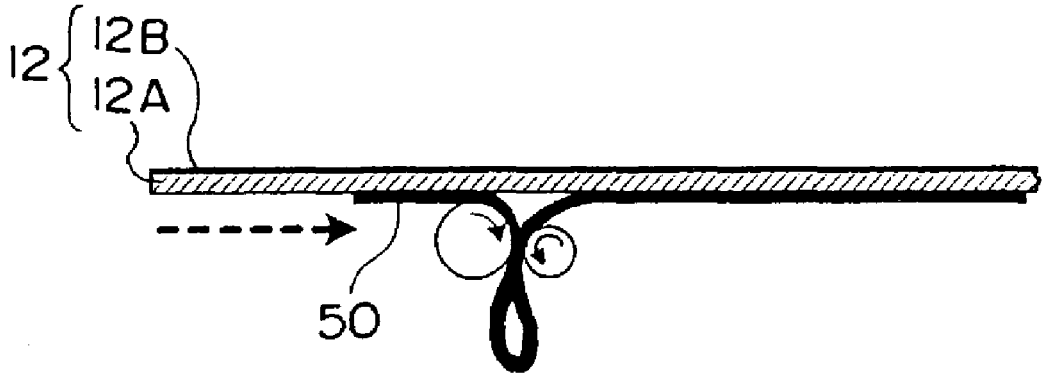

In the above-described embodiment and modified example, the fan 62 is disposed at the inner side of the belt 56 which forms a loop, and the interleaf sheet 50 is peeled off by the suction force of the fan 62. However, a structure such as that shown in FIGS. 4A and 4B may be utilized. As shown in FIG. 4A, a pair of rollers which are a large roller 90 and a small roller 92 are disposed at the interleaf sheet 50 side (the underside). Due to the large roller 90 being rotated in the direction opposite to the conveying direction of the printing plate 12 (see FIG. 4B), the interleaf sheet 50 is drawn in between the pair of rollers 90, 92, and is peeled off.

Further, a separate mechanism may be provided which, when the uppermost material within the cassette 38 is an interleaf sheet 50, directly grasps and lifts only the interleaf sheet 50 from the cassette 50 and discharges the interleaf sheet 50 toward the right side wall of the automatic printing plate exposure device 10.

As described above, the present invention has the excellent effects that, by using a single lift-out mechanism section, an image recording material can be lifted up out from any of plural cassettes along a simple locus of movement, and the space required for placement and withdrawing of the cassettes can be kept as small as possible.

What is claimed is:

1. An image recording material separating/removing device comprising:

a plurality of cassettes, each cassette able to accommodate a plurality of image recording materials substantially horizontally in a stacked manner; and a conveying unit which can access each of the plurality of cassettes in order to remove the image recording materials from each of the plurality of cassettes wherein the conveying unit includes a movable suction mechanism and is configured to invert the image recording material by suctioning one end of the image recording material with the suction mechanism such that one end is raised up and conveyed so as to face the other end of the image recording material, wherein one cassette is positioned at an offset position which is offset in a horizontal direction from a horizontal direction position of a cassette directly beneath the one cassette, at least when the conveying unit accesses the cassette directly beneath the one cassette and each cassette is fixed in advance of the operation of the device at a position which is offset in the horizontal direction from other cassettes and the offset position is less than a length of one cassette.

2. The device of claim 1, wherein the conveying unit is configured to remove image recording materials having a support and an image recording surface.

3. The device of claim 2, wherein the cassette is configured to accommodate image recording materials such that the image recording surfaces of the image recording materials face downward.

4. The device of claim 1, wherein the cassette is configured to accommodate image recording materials that are printing plates.

5. The device of claim 1, wherein the conveying unit has suction cups for sucking the image recording materials, the suction cups being able to move up and down in a substantially vertical direction in order to access each of the cassettes.

6. The device of claim 1, wherein the conveying unit has a conveying roller pair which can nip and feed-out the image recording material which has been removed.

7. The device of claim 1, wherein the conveying unit is configured to remove the image recording material which is uppermost within each cassette.

8. The device of claim 1, further comprising an interleaf sheet discarding device which can peel an interleaf sheet for protection, which sticks to one surface of the image recording material, off from the image recording material.

9. The device of claim 1, further comprising a cassette housing section which can accommodate all of the cassettes.

10. An image recording material separating/removing device comprising:

a plurality of cassettes, each cassette able to accommodate a plurality of image recording materials substantially horizontally in a stacked manner; and a conveying unit which can access each of the plurality of cassettes in order to remove the image recording materials from each of the plurality of cassettes, wherein one cassette is positioned at an offset position which is offset in a horizontal direction from a horizontal direction position of a cassette directly beneath the one cassette, at least when the conveying unit accesses the cassette directly beneath the one cassette wherein the one cassette is reciprocatingly movable between an in-line position and an access position which is offset in the horizontal direction less than a length of a cassette from the in-line position and which allows the one cassette to be accessed by the conveying unit and wherein the conveying unit further comprises a movable suction mechanism and is configured to invert the image recording material by suctioning one end of the image recording material such that one end is raised up and conveyed so as to face the other end of the image recording material.

11. The device of claim 10, wherein the access positions of the cassettes substantially coincide in the horizontal direction.

12. The device of claim 10, wherein directions in which the cassettes move from the access positions to the offset positions are all the same.

13. The device of claim 10, wherein the conveying unit has suction cups for sucking the image recording materials, the suction cups being able to move up and down in a substantially vertical direction in order to access each of the cassettes.

14. The device of claim 10, wherein the conveying unit has a conveying roller pair which can nip and feed-out the image recording material which has been removed.

15. The device of claim 10, wherein the conveying unit is configured to remove the image recording material which is uppermost within each cassette.

16. The device of claim 10, further comprising an interleaf sheet discarding device which can peel an interleaf sheet for protection, which sticks to one surface of the image recording material, off from the image recording material.

17. The device of claim 10, further comprising a cassette housing section which can accommodate all of the cassettes.

* * * * *